US006942532B2

(12) United States Patent
Snyder

(10) Patent No.: US 6,942,532 B2
(45) Date of Patent: Sep. 13, 2005

(54) CLIP FOR SURFBOARD LEASH

(75) Inventor: Charles Edwin Snyder, Hermosa Beach, CA (US)

(73) Assignee: Charles Edwin Synder, Hermosa Beach, CA (US)

( * ) Notice: Subject to any disclaimer, the term of this patent is extended or adjusted under 35 U.S.C. 154(b) by 0 days.

(21) Appl. No.: 10/738,379

(22) Filed: Dec. 17, 2003

(65) Prior Publication Data

US 2004/0180590 A1 Sep. 16, 2004

Related U.S. Application Data

(60) Provisional application No. 60/434,205, filed on Dec. 19, 2002.

(51) Int. Cl.[7] ..... A44B 11/25

(52) U.S. Cl. ..... 441/75; 114/382; 24/327; 24/132 R

(58) Field of Search ..... 114/382, 39.18, 114/39.19; 441/74, 75, 84, 85; 24/327, 329, 335–339, 122.6, 132 R, 134 KA; D08/394–396; 280/814, 637

(56) References Cited

U.S. PATENT DOCUMENTS 3,354,517 A * 11/1967 Levinsky ..... 403/275
4,121,798 A * 10/1978 Schumacher et al. ..... 248/113
4,317,262 A * 3/1982 Wells, Jr. ..... 24/16 PB
4,938,725 A 7/1990 Beck
5,194,026 A * 3/1993 Corwin et al. ..... 441/75
5,230,489 A * 7/1993 White et al. ..... 248/74.2
5,362,270 A * 11/1994 Hanson et al. ..... 441/75
5,490,805 A 2/1996 Bredesen
D402,396 S * 12/1998 Protz, Jr. ..... D26/138
5,938,492 A 8/1999 Carlini
D427,510 S * 7/2000 Gary et al. ..... D8/395
D465,255 S * 11/2002 Lankey ..... D22/139
6,477,744 B1 * 11/2002 Miles ..... 24/3.12
6,523,231 B1 * 2/2003 Lassiter ..... 24/339

* cited by examiner

*Primary Examiner*—S. Joseph Morano
*Assistant Examiner*—Ajay Vasudeva

(57) ABSTRACT

This removable snap-on plastic device can be affixed to a surfboard leash allowing the open outer sleeve portion to clamp onto any adjacent section of the leash to prevent it from unraveling, representing significant improvements over other similar devices. This device does not interfere with the performance of a surfer nor affect the performance of the surfboard leash.

3 Claims, 2 Drawing Sheets

CLIP FOR SURFBOARD LEASH

CROSS REFERENCE TO RELATED APPLICATIONS

This application claims priority over U.S. provisional patent application No. 60/434,205 filed Dec. 19, 2002, the entire contents of which being incorporated herein by reference.

BACKGROUND OF THE INVENTION

1. Field of the Invention

This invention relates generally to a snap-on leash/cord holder, in particular, an inexpensive removable device that keeps a surfboard leash in place so the leash will not unravel while wrapped around a surfboard.

2. Description of the Related Art

Despite the many different devices to retract surfboard leashes and other types of cords, ropes or hoses, those solutions are more complicated than this invention. The purpose of the device of the present invention is to facilitate ease of handling and/or transporting a surfboard with a leash by creating a simple means of affixing the leash [or cord] to itself after it has been wrapped around the surfboard so that the cord does not unravel. This invention is an unobtrusive, non-mechanical accessory that in no way affects the performance capabilities of the leash, power cord, rope, etc. to which it is attached.

In the case of inventions pertaining specifically to surfboards, existing patents are designed to be integrated leash systems as in the case of U.S. Pat. No. 4,938,725: "Retractable Surfboard Leash"; U.S. Pat. No. 5,490,805: "Retractable Surfboard Leash"; and U.S. Pat. No. 5,938,492: "Reel for a Surfboard Leash." These inventions are all mechanical designs utilizing spring-loaded, moving parts. In all of these patents the surfboard leash becomes a permanent component of the invention. It also should be noted that all of these patents are meant to enhance the performance of the leash while the surfboard is being used. While those inventions may be useful in the ocean, the need remains for a device that locks the leash down when it is not attached to the surfer.

BRIEF SUMMARY OF THE INVENTION

Broadly, this invention allows a surfer to wrap the surfboard leash around the surfboard and use the invention to clip/hold the leash in place so it will not unravel. This device does not interfere with the performance of the leash or the performance of the surfer. When used on other cords, this device does not create a performance issue either.

This device offers an improvement over other leash/cord devices. Other devices interfere with the performance of the surfer while in the performance position.

DETAILED DESCRIPTION OF THE INVENTION

Figure 1A:
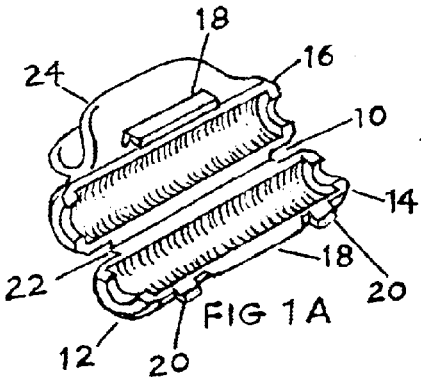
FIG. 1A. is a perspective view of the device showing the body in an open position.
Figure 1B:
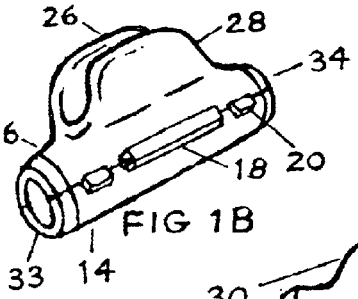
FIG. 1B. is a perspective view showing the body in a closed/locked position.
Figure 2A:
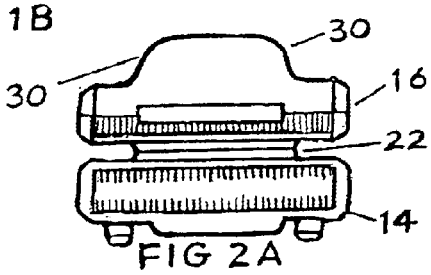
FIG. 2A. is a top view of the body in the open position.
Figures 1C, 1D:
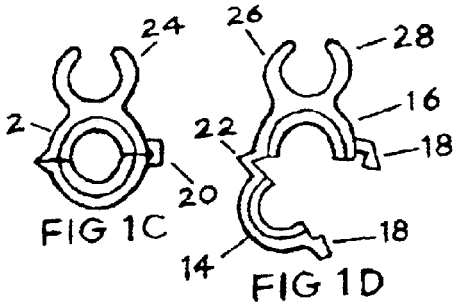
FIG. 1C. is a side view of the body in the closed/locked position.
FIG. 1D. is a side view of the body in the open position.
Figure 2B:
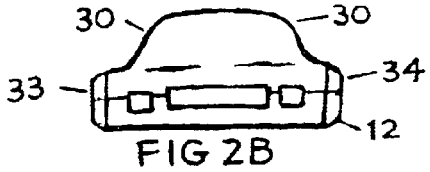
FIG. 2B. is a front view of the body in the closed/locked position.
Figure 3A:
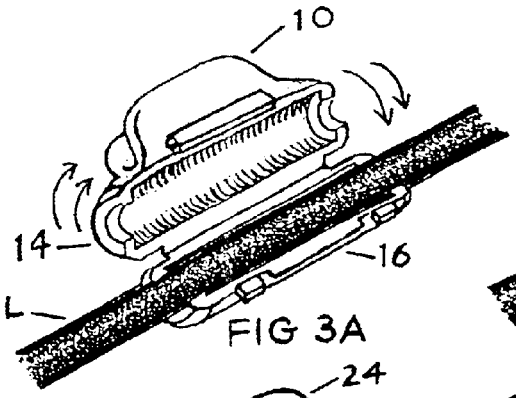
FIG. 3A. is a perspective of the body in the open position with a surfboard leash inside the body with arrows indicating how the body is closed.
Figure 3C:
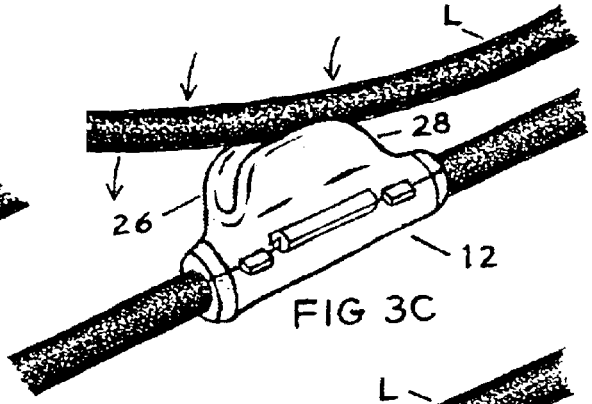
FIG. 3C. is a perspective view showing a portion of the surfboard leash being put inside the outer sleeve of the device.
Figure 3B:
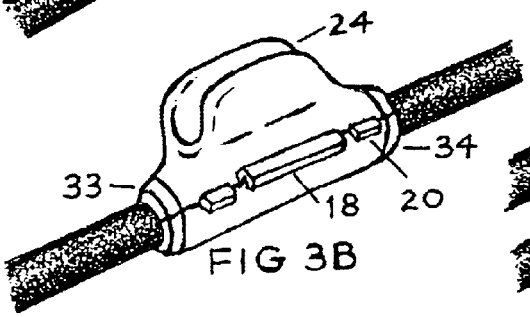
FIG. 3B. is a perspective view showing the body in the closed/locked position with the surfboard leash inside.
Figure 3D:
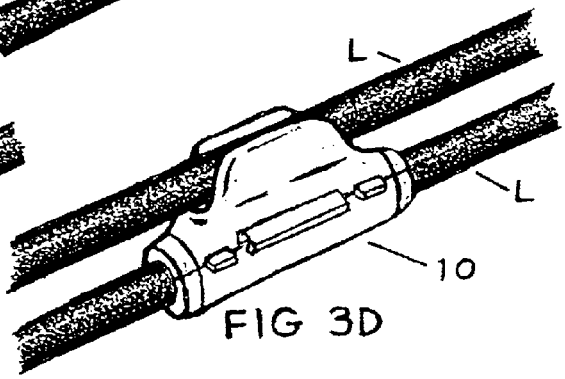
FIG. 3D. is a perspective view showing the portion of the surfboard leach inside the outer sleeve of the device.
Figure 4A:
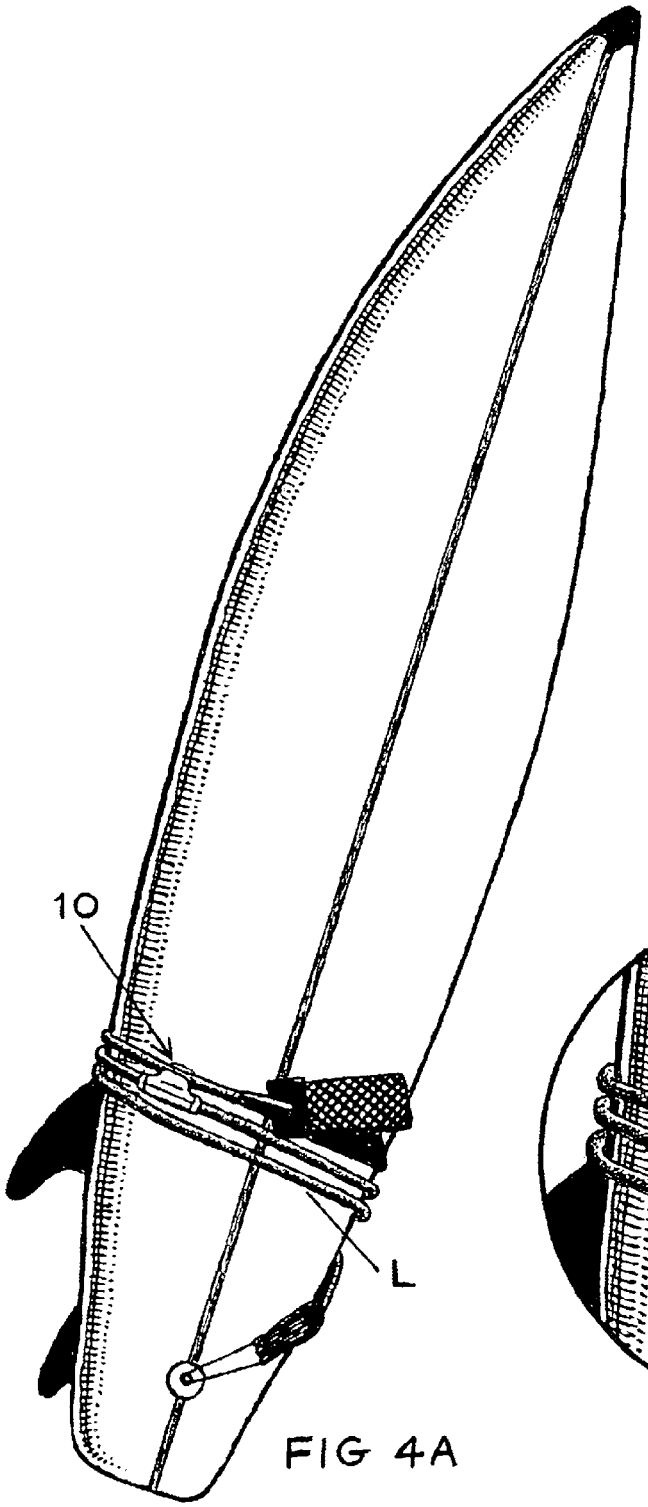
FIG. 4A. is a perspective view showing the surfboard leash in a stored position where it is wrapped around the surfboard with the device attached and a portion of the leash inside the outer sleeve of the device.
Figure 4B:
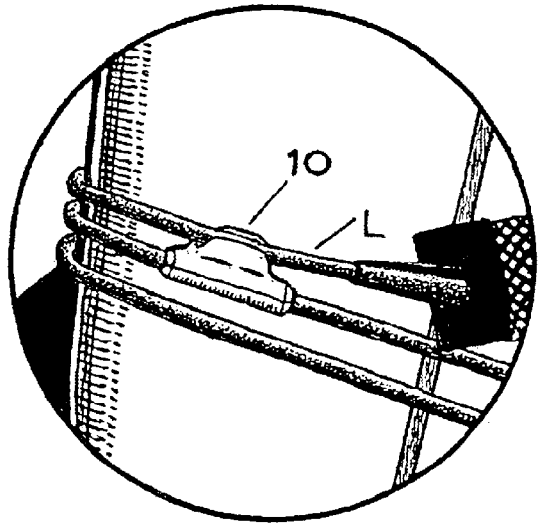
FIG. 4B. is an enlargement of a part of FIG. 4A.

This snap-on surfboard leash holder/clip 10 includes a hollow plastic body 12 of a generally cylindrical shape, which is split down the middle and into two half cylinders 14, 16 can be opened lengthwise and closed and snapped shut repeatedly via a hinge/tab configuration. When the two half cylinders 14, 16 are opened relative one another, a "C" shape is evident when viewing the device from either end (see FIG. 1D). The purpose of the open "C" is to enable a surfboard leash L to be placed inside the opening of the body 12. This surfboard leash clip 10 is designed to be used when the leash L is in storage position, not when the surfboard and leash L are being operated. To unclip the device 10 from the surfboard leash L, one simply pulls the leash L with minimal pressure at or near the tabs 18, 20 holding the two halves 14, 16 together and the leash L will release freely from the device 10.

As discussed above, this invention provides an inexpensive device 10 which will allow a surfboard leash L to stay affixed while the leash L is wrapped around a surfboard for storage or transporting purposes. The device 10 does not interfere with the performance of the surfer while the surfboard is being used in the water. This device 10 simply attaches to the surfboard leash L via a reusable hinge 22/tab 18, 20 configuration and attaches to another part of the leash L simply by applying slight pressure to snap the leash L into the outer sleeve 24 portion of the device. The outer sleeve portion 24 has a pair of somewhat flexible upstanding legs 26, 28 that are spaced apart slightly less than the diameter of a conventional surfboard leash L. Advantageously the length of the upstanding legs 26, 28 are of sufficient length to retain the leash L but no longer than necessary so as to reduce the bulk of the device 10, and the upstanding legs 26, 28 have rounded corners 30 to prevent inadvertently injuring the user. The device 10 is constructed of injection-molded plastic (in one piece, requiring no assembly) and contains no moving parts. This device 10 can be used to provide the same function on other type of cord and ropes.

Use of the device 10 is as follows. The device 10 is opened so that it can be placed on the leash L wherever the user prefers, then when it is snapped shut it remains tightly affixed around that particular section of the leash L. The body 12 of the device 10 is prevented from slipping along the leash L by an opposing pair of end caps 33, 34 that tightly grip the leash L. After the leash L is wrapped around the surfboard (perpendicular to the length of the board) the section of the leash L where the device 10 is attached can then snap onto any adjacent section of the same leash L essentially securing the leash L to itself, thus preventing the leash L from unraveling until the user so desires. The leash L can then be quickly pulled free so that it can be unwound for use in the water. The snap-on device 10 can also be easily removed in order to place it on a different section of the leash L (as accords the preference of the user) or in the event that the user wishes to place the device 10 on another leash L entirely.

While the present invention has been described with regards to particular embodiments, it is recognized that additional variations of the present invention may be devised without departing from the inventive concept.

What is claimed is:

1. A clip for a surfboard leash, comprising:

a primary sleeve having an elongate body with an annular channel therethrough and secured about a length of the surfboard leash, wherein the primary sleeve is split into first and second halves along the elongate body, the halves being connected by a hinge along first sides of the halves for pivotal movement between open and closed positions and selectively connected by a latching mechanism along second sides of the halves, the halves when secured about the surfboard leash in the closed position tightly gripping the leash to prevent slippage relative the primary sleeve; and an elongate outer sleeve having a generally C shaped cross section and attached to one of the halves of the primary sleeve, wherein the outer sleeve is sized to receive in an interference fit and retain the surfboard leash without movement relative the outer sleeve, whereby the body of the primary sleeve is installed on a first portion of the leash and the leash wrapped around the board and the outer sleeve used to engage a second portion of the leash thereby preventing the leash from unraveling.

2. The clip for a surfboard leash of claim 1 wherein the clip is one piece and made of injection-molded plastic.

3. The clip for a surfboard leash of claim 2 wherein the body is generally cylindrically shaped.

* * * * *